US007482105B2

(12) United States Patent
Hirose et al.

(10) Patent No.: US 7,482,105 B2
(45) Date of Patent: Jan. 27, 2009

(54) TONER FOR ELECTROSTATIC LATENT IMAGE DEVELOPMENT AND MANUFACTURING METHOD OF THE TONER FOR ELECTROSTATIC LATENT IMAGE DEVELOPMENT

(75) Inventors: Naohiro Hirose, Hachioji (JP); Ken Ohmura, Hachioji (JP); Meizo Shirose, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 237 days.

(21) Appl. No.: 10/951,221

(22) Filed: Sep. 27, 2004

(65) Prior Publication Data

US 2005/0069802 A1 Mar. 31, 2005

(30) Foreign Application Priority Data

Sep. 30, 2003 (JP) ..... 2003-339535

(51) Int. Cl.
*G03G 9/08* (2006.01)

(52) U.S. Cl. ..... 430/109.3; 430/109.4; 430/110.1; 430/110.3

(58) Field of Classification Search ..... 430/109.3, 430/109.4, 110.1, 110.3
See application file for complete search history.

(56) References Cited

U.S. PATENT DOCUMENTS

| | | | | |
|---|---|---|---|---|
| 4,855,209 | A * | 8/1989 | Martin et al. | 430/109.3 |
| 4,971,879 | A | 11/1990 | Kimura et al. | |
| 5,324,616 | A * | 6/1994 | Sacripante et al. | 430/137.12 |
| 5,397,667 | A * | 3/1995 | Law et al. | 430/108.7 |
| 5,451,481 | A * | 9/1995 | Law et al. | 430/108.8 |
| 5,601,923 | A * | 2/1997 | Koyama et al. | 428/402 |
| 6,316,156 | B1 * | 11/2001 | Takiguchi et al. | 430/109.4 |
| 6,495,648 | B1 * | 12/2002 | Inagaki et al. | 526/347 |
| 7,070,898 | B2 * | 7/2006 | Nakamura et al. | 430/108.8 |
| 7,094,513 | B2 * | 8/2006 | Yasumatsu et al. | 430/108.23 |

FOREIGN PATENT DOCUMENTS

| | | |
|---|---|---|
| JP | 05127424 | 5/1993 |
| JP | 2002-082472 | 3/2002 |
| JP | 2002148857 | 5/2002 |
| JP | 2003-207938 | 7/2003 |

* cited by examiner

*Primary Examiner*—Hoa V Le
(74) *Attorney, Agent, or Firm*—Lucas & Mercanti, LLP

(57) ABSTRACT

A toner for electrostatic latent image development contains a toner particle having a median diameter (d50) in number standard of 2.5 μm to 7.5 μm, acrylate of less than 12 ppm and aliphatic alcohol of 4 to 12 carbons of 40 ppm to 300 ppm.

17 Claims, 3 Drawing Sheets

TONER FOR ELECTROSTATIC LATENT IMAGE DEVELOPMENT AND MANUFACTURING METHOD OF THE TONER FOR ELECTROSTATIC LATENT IMAGE DEVELOPMENT

BACKGROUND

1. Field of the Invention

The present invention relates to a toner for electrostatic latent image development and a manufacturing method of the toner for electrostatic latent image development.

2. Description of Related Art

In the image forming method by electrophotography, a latent image is formed on a photoconductor which utilizes a photoconductive material, the latent image is developed by using a toner, the image formed on the photoconductor is directly transferred to a recording material such as a paper via an intermediate transferring body, fixing the transferred image onto a recording material, and a toner image is formed on the recording material. Successively, the toner left on the photoconductor is removed. These processes are repeated.

In recent years, such electrophotography is getting applied to full-color image forming. The field of electrophotography is spreading not only to document printing in an office with a copier or printer, but also to a light printing field.

An image forming showing high resolution and beautiful color tone which are equal to or better than those of printed matter is required. As for one means which attains these requirements, miniaturization of particle size in polymerization toner has been examined (for example, see Tokukai 2003-207938A).

However, It has found that new problem occurs in miniaturizing particle size of a toner. That is, it is the problem that an electrostatic charge amount per unit mass remarkably increases since relative surface area of a toner increases with miniaturizing the particle size.

As a result, develop amount in image forming becomes instable, and it becomes difficult to form a toner image having preferable image quality. Further, an image forming method using the small size toner effects a lifetime of a charge providing member such as a carrier and developing roller.

As described above, the miniaturization of a toner for increasing resolution of an image causes a variation of a develop amount, thus results the problem in achieving an image forming with high image quality.

When develop amount in image forming is variable as described above, it easily occurs that a user is compelled to exchange a toner unexpectedly. For example, it is a burden that a toner has to be exchanged in time-sensitive situation such as making a material for a discussion right before that.

Further, for a user who makes living in light printing, a time period in stopping the apparatus for toner exchange at work may directly cause a money loss. Thus a problem of downtime for toner exchange is not negligible from a viewpoint of the user.

According to the above problems, the manufacturing process of the small size toner by polymerization method is controlled to exclude factors to cause over-charge of the toner as much as possible. Therefore, this considerably affects the productivity of the toner.

Further, it is urgent to lower a cost of manufacturing a polymerization toner which is advantageous in miniaturizing the particle size. Thus, it is strongly desired to improve an effectiveness of production (productivity).

Another object of one aspect of the invention is to provide the toner where develop amount is stable, high resolution image can be obtained, lifetime of a charge providing member is long, a downtime for an exchange can be greatly reduced, and furthermore, to provide the manufacturing method of a toner having high productivity.

SUMMARY

The first aspect is a toner for electrostatic latent image development containing a toner particle having a number average particle size of 2.5 μm to 7.5 μm, acrylate of less than 12 ppm, aliphatic alcohol of 4 to 12 carbons of 40 ppm to 300 ppm.

The second aspect is a toner for electrostatic latent image development containing a toner particle having a number average particle size of 2.5 μm to 7.5 μm, acrylate of less than 12 ppm, aliphatic alcohol of 4 to 12 carbons of 40 ppm to 300 ppm, wherein the toner is obtained through adding at least one kind of acid in agglomerating a resin particle.

The third aspect is a manufacturing method for a toner for electrostatic latent image development comprising:

performing a polymerization reaction of a polymerizable monomer in an aqueous medium to obtain a resin particle, agglomerating the resin particle and adding at least one kind of acid in the agglomerating.

BRIEF DESCRIPTION OF THE DRAWINGS

The present invention will become more fully understood from the detailed description given hereinbelow and the appended drawings given by way of illustration only, and thus are not intended as a definition of the limits of the present invention, and wherein.

DETAILED DESCRIPTION OF THE EXEMPLARY EMBODIMENTS

Figure 1:
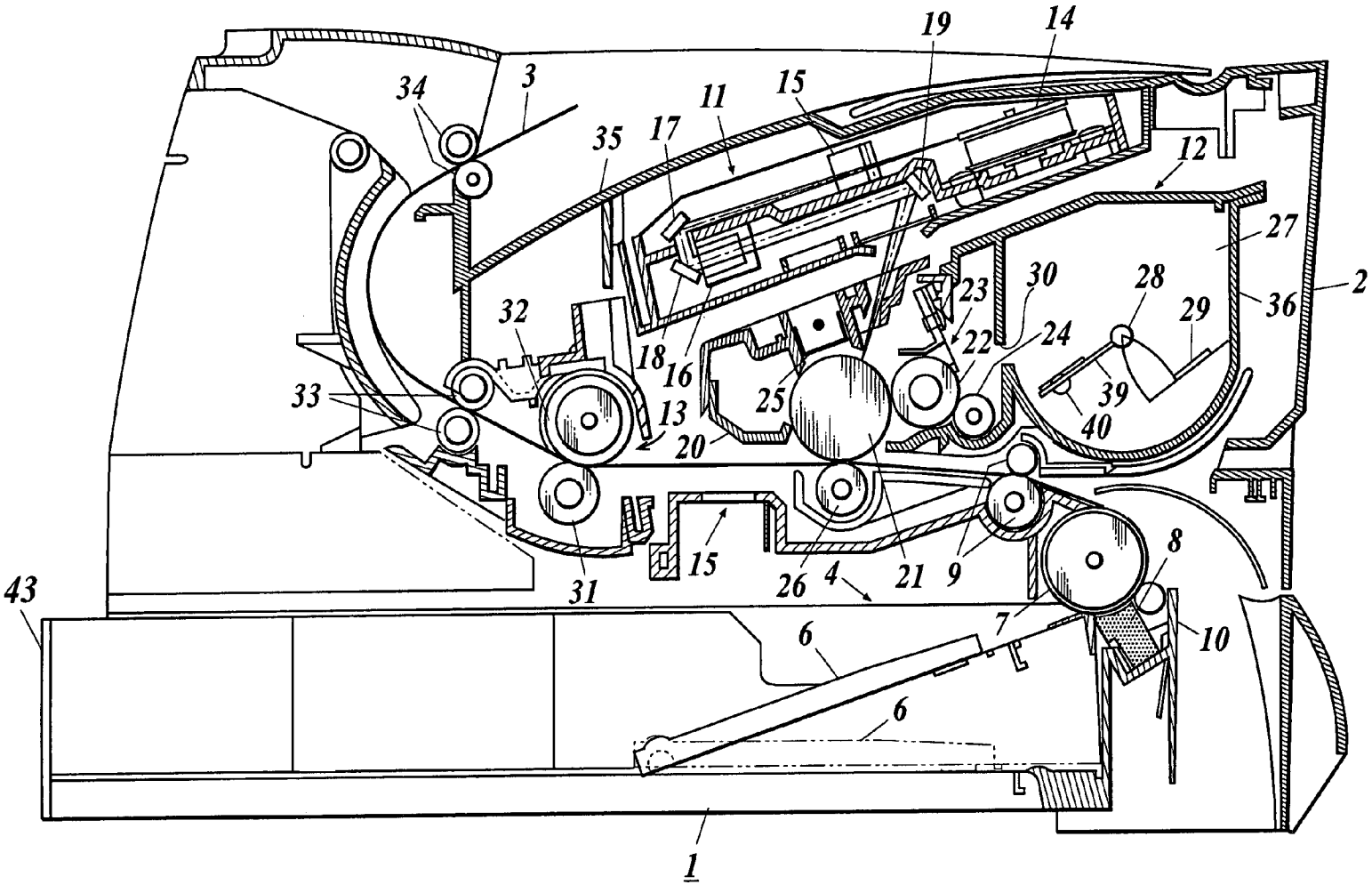
FIG. 1 is a side section view of main components showing one of embodiments of a laser printer as an image forming apparatus of the invention.

The present invention is related to a toner for electrostatic latent image development, in which a small size toner contains aliphatic alcohol having particular number of carbon atoms, the amount thereof is in a particular range, and the toner contains acrylate, which is a residual monomer in the toner, within a particular range.

The present inventors have studied and investigated the above problems. As for the factor which causes the development variation, firstly they focused on an over-charged small size toner, and found out that the problem is dissolved when it contains alcohol having particular number of carbon atoms. As for the second factor, they focused on decreasing van der Waals force between the toner and a charge providing member, and found out the van der Waals force can be decreased by restraining the amount of the residual acrylate monomer which has not polymerized and left in the toner.

Further, they also found the above constitutions allows to extend the lifetime of the charge providing member, since over-charge of the toner can be restrained.

The manufacturing method of the toner for electrostatic latent image development according to the invention can remarkably reduce the manufacturing time of the toner which has the above-described effects of the invention compared to earlier development. Thus, it becomes possible to manufacture a high performance toner at low cost.

Hereinafter, each of the components in the invention will be described in detail.

a. Toner for Electrostatic Latent Image Development

The toner for electrostatic latent image development of the invention will be explained.

The toner for electrostatic latent image development of the invention comprises at least binder resin and a colorant as the components thereof. In order to obtain the effects disclosed in the invention, it is preferable that the toner contains less than 12 ppm of acrylate and 40 ppm to 300 ppm of aliphatic alcohol of 4 to 12 carbon atoms.

a.1. Acrylate

The acrylate in the invention will be explained.

As for the acrylate in the invention, for example, acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate can be given. The content of the acrylate in the toner is preferably 6 ppm or less, and more preferably 0 to 3 ppm. One or more kind of acrylate can be contained in the toner.

Here, as for the content of the acrylate in the toner, identification and content of the acrylate can be analyzed by an after-mentioned head space method.

The acrylate in the invention can be used as an after-mentioned polymerizable monomer for manufacturing the binder resin constituting the toner. However, the content thereof in the toner is as described above.

a.2. Aliphatic Alcohol of 4 to 12 Carbon Atoms

The toner for electrostatic latent image development (also simply referred to as a toner) is characterized in that the toner contains 40 ppm to 300 ppm of aliphatic alcohol of 4 to 12 carbon atoms.

As for the number of carbon atoms of the aliphatic alcohol in the invention, the carbon number of 4 to 9 is preferable, and the carbon number of 4 to 6 is more preferable. Further, as for the content thereof, a range within 70 ppm to 250 ppm is preferable, and a range within 100 ppm to 200 ppm is more preferable.

Here, the identification and content of the alcohol component is measured by a head space method as described below.

As for the aliphatic alcohol of 4 to 12 carbon atoms, alcohols such as 1-butanol, sec-butanol, tert-butanol, amyl alcohol, isoamyl alcohol, n-hexanol, n-octanol, n-decylalcohol, n-dodecylalcohol can be given. Among them, 1-butanol, sec-butanol, amyl alcohol, isoamyl alcohol, n-hexanol, n-octanol and the like are preferable. Further, polyvalent alcohol derivatives such as ethylene glycol diacetate, ethylene glycol diethylether, ethylene glycol diglycidylether, ethylene glycol dimethylether, ethylene glycol monomethylether, propylene glycol monobutylether, propylene glycol monomethylether, hexylene and hexylene glycol can be also given.

Among them, 1-butanol and tert-butanol can be given as particularly preferable alcohol component.

a.3. Polymerizable Monomer

As for the polymerizable monomer constituting the binder resin will be explained.

As for the polymerizable monomer in the invention, for example, styrenes or styrene derivatives such as styrene, o-methyl styrene, m-methyl styrene, p-methyl styrene, α-methyl styrene, p-chlorostyrene, 3,4-dichlorostyrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, and p-n-dodecyl styrene, methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethyl hexyl methacrylate, stearyl methacrylate, lauryl methacrylate, phenyl methacrylate, diethylaminoethyl methacrylate, and dimethylaminoethyl methacrylate, olefins such as ethylene, propylene, and isobutylene, halogen series vinyls such as vinyl chloride, vinylidene chloride, vinyl bromide, vinyl fluoride, and vinylidene fluoride, vinyl esters such as vinyl propionate, vinyl acetate, and vinyl benzoate, vinyl ethers such as vinyl methyl ether and vinyl ethyl ether, vinyl ketones such as vinyl methyl ketone, vinyl ethyl ketone, and vinyl hexyl ketone, N-vinyl compounds such as N-vinylcarbazole, N-vinyl indole, and N-vinyl pyrrolidone, vinyl compounds, such as vinyl naphthalene and vinylpyridine, acrylate or methacrylate derivatives such as acrylonitrile, methacrylonitrile, and acrylamide can be given.

a.4. Analysis by Head Space Method

A head space method is preferably used as an identification method and quantitative determination method for the acrylate, aliphatic alcohol of 4 to 12 carbons, polymerizable monomer and the like in the toner. Primarily, a head space method is greatly suitable for measuring the volatile component of the toner. In the invention, since the head space method shows extremely high precision and the measurement results highly correlates with the various effects disclosed in the invention, the head space method is employed as the analysis and quantitative determination method.

The head space method is one that a predetermined amount of toner is sealed in a container which can be opened and closed, heated up to a predetermined temperature, and when the inside of the container is filled with the volatile component, the gas in the container is injected to a gas chromatographic detector so that the amount of the volatile component is measured while the compound thereof is identified by a mass analysis.

As for the method for measuring the impurities derived from the binder resin and small quantity of the additives, it is well known that binder resin or toner is dissolved to solvent and the solution is injected to a gas chromatographic detector. However, the peaks of the impurities or small amount of additives to be measured may be hidden with the peak of the solvent. Thus, the above-described head space method is employed in order to measure the total amount of the volatile component in the invention. Further, in the head space method, every peak of the volatile component is possibly detected by a gas chromatography, while the acrylate component, aliphatic alcohol component of 4 to 12 carbon atoms, volatile compound, polymerizable monomer and the like can be specified and determined quantitatively in high precision by using an analysis method utilizing electromagnetic interaction.

a.5. Measuring Condition of the Head Space Method

Hereinafter, the measurement by the head space method will be explained in detail.

a.5.1. Measuring Method

1. Collection of Sample

The sample (0.8 g) is collected to a 20 ml vial for head space. The amount of the sample is weighed at 0.01 g order (it is needed for calculating an area per unit mass). The vial is sealed with a septum by using a special crimper.

2. Heating of the Sample

The sample is put into a temperature-controlled bath of 170° C. for 30 minutes, in a condition that the sample is disposed longitudinally.

3. Setting of Gas Chromatography Separation Condition

A column having an inner diameter of 3 mm and a length of 3 m is filled with carrier coated with silicone oil SE-30 where the mass ratio thereof of 15%, and this column is used as a separation column. The separation column is installed to a gas chromatograph detector, and carrier gas of He is flown at 50 ml/min. The temperature of the separation column is set at 40° C. and the measurement is carried out while the temperature is heated up to 260° C. at 15° C./min and kept at 5 min at 260° C.

4. Introduction of the Sample

The vial is picked up from the temperature-controlled bath and immediately 1 ml of the sample is injected with a gas tight syringe.

5. Calculation

The calibration curves are obtained previously, where n-butanol is used as a reference material for quantitative determination of alcohol, and butyl acrylate is used as a reference material for quantitative determination of acrylate. The concentrations of each of the components are obtained.

6. As for the Constitution of the Apparatus, the Following Constitution is Preferably Used.

(a) Head Space Condition

Head space unit:

HP7694 Head space Sampler (made by Agilent Corp (former, Hewllet Packard Co.))

Temperature condition:

Transfer line: 200° C.

Loop temperature: 200° C.

Sample amount: 0.8 g/20 ml vial (b) GC/MS condition

GC: HP5890 (made by Agilent Corp (former, Hewllet Packard Co.))

MS: HP5971 (made by Agilent Corp (former, Hewllet Packard Co.))

Column: HP-624 (30 m×0.25 mm)

Oven temperature:

Initial temperature: 40° C. (3 min)

Temperature rising rate: 15° C./min

Final temperature: 260° C.

Measurement mode: SIM (select ion monitor) mode a.6. Content Ratio of the Metal Element to the Chlorine or Sulfur Contained in the Toner (Molar Ratio)

The toner of the invention preferably contains at least one element selected from the group consisting of sodium, potassium, magnesium, zinc and aluminum. It is more preferable that the toner contains at least one element selected form the group consisting of sodium, magnesium and aluminum.

According to the invention, it is preferable that the ratio of the above elements to the chlorine or sulfur in the toner (molar ratio) fulfills the relations represented by the following general formulas (1) or (2).

The chlorine element or sulfur element in the toner preferably derives from the acid used in the manufacturing method of the toner for electrostatic latent image development.

As for the manufacturing method of the toner, a manufacturing method in which the colorant particles are obtained through a process of agglomerating and fusing a small amount of resin particles. In this case, the chlorine element or sulfur element in the toner is preferably derives from the acid added in the agglomerating process or the fusing and associating with agglomerating process. Here, hydrochloric acid and sulfuric acid are preferable as the acid to be added, and hydrochloric acid is the most preferable.

It is preferable that the toner where hydrochloric acid is used as the acid fulfills the following formula (1) and the toner where sulfuric acid is used as the acid fulfills the following formula (2).

In the agglomerating process or fusing and associating with agglomerating process of the resin particles, the concentration of the acid is preferably 1 mol/l to 3 mol/l. In the case that the acid is added in the agglomerating process, it is preferable that the acid is used within a range of 1/10 to 2/5 (volume ratio) of the resin dispersions (also referred to as associations).

The reason why the manufacturing method, where an acid is added in the agglomerating process or the fusing and associating process with agglomeration process of the resin particles, has high productivity will be explained in the aftermentioned manufacturing method of the toner for electrostatic latent image development.

a.6.2. In a Case of Adding Hydrochloric Acid

In the toner of the invention, a ratio (B/A) of the toner in the invention preferably fulfills the following general formula (1), where A represents the total content of the above elements in the toner and B represents the content of the chlorine in the toner.

$$0.7<B/A<5 \qquad \text{General formula (1)}$$

Preferably the range is 0.97<B/A<3, more preferably the range is 1.1<B/A<2.5.

a.6.3. In the Case of Adding Sulfuric Acid

In the case that sulfuric acid is used, a ratio (C/A) of the toner in the invention preferably fulfills the following general formula (2), where A represents the total content of the above elements in the toner and C represents the content of the sulfur element in the toner.

$$5<C/A<20 \qquad \text{General formula (2)}$$

Preferably the range is 6<C/A<15, and more preferably the range is 8<C/A<12.

Here, the content ratios of the metal elements included in the toner to the chlorine or sulfur (molar ratio) represented by the above general formulas (1) and (2) can be measured by identification and quantitative determination of the elements with WDX (wavelength dispersive X-ray spectrometry).

b. Manufacturing Method of the Toner for Electrostatic Latent Image Development

The manufacturing method of the toner for electrostatic latent image development will be explained.

The manufacturing method of the toner for electrostatic latent image development is characterized in that it comprises a process to prepare dispersions of resin particles by polymerization reaction of polymerizable monomers in an aqueous medium, and subsequently a process to add at least one kind of acid (the kind and amount thereof are described above) in an agglomerating process or fusing and associating with agglomerating process of the resin particles.

In performing the polymerization reaction for obtaining the binder resin particles of the invention, the binder resin particles can be obtained with a polymerization reaction process consisting of one step. However, as described below, the toner obtained by so-called multistage polymerization reaction, in which composite binder resin is prepared through at least two polymerization reaction stages, is preferably used in the invention.

b.1. Preparation of the Composite Binder Resin in the Multistage Polymerization Reaction Process It is preferable that the toner of the invention is prepared by forming the composite resin particles under non-presence of a colorant, adding dispersions of colorant particles into the dispersions of the composite resin particles, and salting-out, agglomerating and fusing the composite resin particles and colorant particles.

Since the composite resin particles are prepared under a system including no colorant as described above, it is unlikely that the polymerization reaction for obtaining the composite resin particles is inhibited. Thus, superior resistance to offset property is hardly degraded and contamination of fixing unit and image due to accumulation of toner is hardly generated in the toner of the invention.

Further, since the polymerization reaction for obtaining the composite resin particles is performed precisely, it is unlikely that the monomer and oligomer are left in the obtained toner particles. Thus, it is unlikely that off-odor is generated in a heat fixing process included in the image forming method using the toner of the invention.

Since the surface property of the obtained toner is uniform and the electrostatic charge distribution thereof is sharp, it is possible to form an image having superior sharpness for a long period.

The "composite resin particles" constituting the toner of the invention designates multi-layered resin particles where the surface of the nucleus particles made of resin is covered with one or more coating layer(s) made of resins whose molecular weight and/or composition is/are different from that of the resin constituting the nucleus particles.

"Central portion (nucleus)" of the composite resin particle designates the "nucleus particle" constituting the composite resin particles.

"Outer layer (shell)" of the composite resin particle designates the outermost layer of the "one or more coating layer(s)" constituting the composite resin particles.

"Intermediate layer" of the composite resin particle designates the coating layer formed between the central portion (nucleus) and outer layer (shell).

The molecular weight distribution of the composite resin particle is not monodisperse and generally shows molecular weight gradient from the central portion (nucleus) to the outer layer (shell).

It is preferable that the present invention employs a "multistage polymerization method" in order to obtain the composite resin particles from a viewpoint of controlling the molecular weight distribution, i.e. from a viewpoint of obtaining fixing property and resistance to offset property. In the invention, the "multistage polymerization method" to obtain the composite resin particles designates a method that resin particles (n) obtained by giving a polymerization treatment ($n^{th}$ stage) to monomer, a polymerization treatment is given to monomer (n+1) under a presence of the resin particles (n), so that a coating layer (n+1) made of polymer of the monomer (n+1) (resin whose distribution and/or composition is/are different from the component resin of the resin particles (n)) is formed on the surface of the resin particles (n).

Here, when the resin particles (n) are nucleus particles (n=1), the method is a "two-stage polymerization method", and when the resin particles (n) are composite resin particles ($n \geqq 2$), the method is a multistage polymerization method consisting of more than 3 stages.

A plurality kinds of resin whose composition and/or molecular weight is/are different from each other are included in the composite resin particles obtained by the multistage polymerization method. Thus, the toner obtained by salting-out, agglomerating and fusing the composite resin particles and colorant particles has distinctly small variation of the composition, molecular weight and surface property among the toner particles.

The usage of the toner whose composition, molecular weight and surface property are uniform among the toner particles thereof as described above makes it possible to improve the resistance to offset property and resistance to twining property while keeping the fine adhesive property to an image support (high fixing property) in an image forming method including a fixing process by a contact heating method. Thus, an image having proper glossiness can be obtained.

One of examples of the manufacturing method of the toner for electrostatic latent image development according to the invention will be described concretely. The method comprises:

(1) a multistage polymerization process (I) to obtain composite resin particles prepared so as to contain a lubricant and/or crystalline polyester at the region other than the outermost layer (the central portion or intermediate layer), (2) a salting-out, agglomerating and fusing process (II) to obtain toner particles by salting-out, agglomerating and fusing the composite resin particles and colorant particles, the above-described addition of acid (hydrochloric acid, sulfuric acid or the like) is carried out in this process (2), (3) filtrating and washing process to filtrate the toner particles from the dispersions of the toner so as to remove a surfactant or the like from the toner particles, (4) drying process to dry the toner particles to which the washing process-has been given, and (5) adding process to add an external additive to the toner particle to which the drying process has been given.

Hereinafter, each of the processes will be explained.

b.2. Multistage Polymerization Process (I)

The multistage polymerization process (I) is to manufacture the composite resin particles by the multistage polymerization method that the coating layer (n+1) made of the polymer of the monomer (n+1) is formed on the surface of the resin particles (n). Here, it is preferable that the multistage polymerization method of 3 stages or more is employed from a viewpoint of the stability of the manufacture and crushing strength of the obtained toner.

Hereinafter, a two-stage polymerization method and a three-stage polymerization method, which are representatives of the multistage polymerization method, will be explained.

b.2.1. Explanation of the Two-Stage Polymerization Method

The two-stage polymerization method is to manufacture the composite resin particles composed of the central portion (nucleus) made of a high molecular weight resin containing a lubricant and the outer layer (shell) made of a low molecular weight resin. That is, the composite resin obtained by the two stage polymerization method particles are composed of a nucleus and one layer of a coating layer.

This method will be explained in detail. Firstly, a monomer solution in which a lubricant is dissolved into a monomer (H) is dispersed to an aqueous medium (aqueous solution of a surfactant) to be oil droplets, and a polymerization treatment (first stage polymerization) is given to the system, so that the dispersions of the high molecular weight resin particles (H) containing a lubricant are prepared.

Next, a polymerization initiator and a monomer (L) to obtain low molecular weight resin are added to the dispersions of the resin particles (H), and a polymerization treatment (the second polymerization) is given to the monomer (L) under a presence of the resin particles (H), so that a coating layer (L) made of a low molecular weight resin (polymer of the monomer (L)) is formed on the surface of the resin particles (H).

b.2.2. Explanation of the Three-Stage Polymerization Method

The three-stage polymerization method is to manufacture the composite resin particles composed of a central portion (nucleus) made of high molecular weight resin, an intermediate layer containing a lubricant and an outer layer (shell) made of low molecular weight resin. That is, the composite resin particles obtained by the three-stage polymerization are composed of a nucleus and two layers of coating layers.

This method will be described concretely. Firstly, a dispersions of resin particles (H) obtained by a polymerization treatment (the first polymerization) according to a general procedure are added to an aqueous medium (solution of a surfactant) while monomer solution in which a lubricant is dissolved to a monomer (M) is dispersed to the aqueous medium to be oil droplets. Subsequently, a polymerization treatment (the second-stage polymerization) is given to this system, so that dispersions of composite resin particles [high molecular weight resin (H)—medium molecular weight resin (M)] in which a coating layer (M) (intermediate layer) made of resin containing a lubricant (polymer of the monomer (M)) is formed on the surface of the resin particles (H) (nucleus particles) are prepared.

Next, polymerization initiator and a monomer (L) to obtain low molecular weight resin are added to the dispersions of the obtained composite resin particles, and a polymerization treatment (the third-stage polymerization) is given to the monomer (L) in a presence of the composite resin particles, so that a coating layer (L) made of low molecular weight resin (polymer of the monomer (L)) is formed on the surface of the composite resin particles.

According to this three-stage polymerization method, the dispersions of the resin particles (H) is added to the aqueous medium (aqueous solution of a surfactant) in forming the coating layer (M) on the surface of the resin particles (H), the monomer solution in which a lubricant is dissolved to the monomer (M) is dispersed to the aqueous medium to be oil droplets and subsequently polymerization treatment (the second stage polymerization) is given to the system. Therefore, it becomes possible to disperse the lubricant finely and uniformly.

It is to be noted that either the adding treatment of the dispersions of the resin particles (H) or the dispersing treatment to be oil droplets of the monomer solution can be performed firstly, or both of them can be performed simultaneously, as described below.

(a) A mode that in forming the intermediate layer constituting the composite resin particles, the resin particles to be the central portion (nucleus) of the composite resin particles is added to an aqueous solution of a surfactant, subsequently the monomer composition containing a lubricant/crystalline polyester is dispersed to the aqueous solution, and a polymerization treatment is given to this system.

(b) A mode that in forming the intermediate layer constituting the composite resin particles, monomer composition containing a lubricant/crystalline polyester is dispersed to an aqueous solution of a surfactant, subsequently the resin particles to be the central portion (nucleus) of the composite resin particles are added to the aqueous solution, and a polymerization treatment is given to this system.

(c) A mode that in forming the intermediate layer constituting the composite resin particles, a monomer composition containing a lubricant/crystalline polyester is dispersed to an aqueous solution of a surfactant simultaneously with adding the resin particles to be the central portion (nucleus) of the composite resin particles to the aqueous solution, and a polymerization treatment is given to the system.

As for the method for forming the resin particles (nucleus particles) or the coating layer (intermediate layer) containing a lubricant, a method in which latex particles are obtained by dissolving a lubricant to a monomer, dispersing the obtained monomer solution to an aqueous medium to be oil droplets, and giving a polymerization treatment to this system can be employed.

The "aqueous medium" represents the medium made up of 50 to 100 mass % of water and 0 to 50 mass % of water-soluble organic solvent. As the water-soluble organic solvent, it is possible to exemplify methanol, ethanol, isopropanol, butanol, acetone, methylethylketone, tetrahydrofuran and the like, and alcohol type organic solvents which do not dissolve the obtained resin are preferable.

As for the suitable polymerization method for forming the resin particles or coating layer containing a lubricant, a method that monomer solution in which a lubricant is dissolved to a monomer is dispersed to an aqueous medium in which a surfactant is dissolved at concentration not more than the critical micelle concentration thereof with utilizing mechanical energy to be oil droplets so that the dispersions is prepared, an water-soluble polymerization initiator is added to the obtained dispersions so that radical polymerization is performed in the oil droplets can be given (hereinafter, referred to as a "mini-emulsion method"). It is also possible that an oil-soluble polymerization initiator is added to the monomer solutions in place of or together with a water-soluble polymerization initiator.

According to the mini-emulsion method in which oil droplets are formed mechanically, the lubricant dissolved into the oil phase is not eliminated and a sufficient amount of a lubricant can be introduced to the resin particles or coating layer to be formed, unlike in the case of general emulsion polymerization method.

Here, a dispersing machine for forming oil droplets by mechanical energy is not especially limited, and can include a mixing apparatus comprising a rotor rotating at high speed, "Clearmix" (supplied from M Technique Co., Ltd.), an ultrasonic dispersing machine, a mechanical homogenizer, Manton Gaulin, a press type homogenizer and the like. Dispersed particle size is from 10 to 1000 nm, preferably from 50 to 1000 nm, and more preferably from 30 to 300 nm.

As for the polymerization method for forming the resin particles or coating layer containing a lubricant, known methods such as a emulsion polymerization method, suspend polymerization method, seed polymerization method and the like can be employed. These polymerization methods can be also employed for obtaining the resin particles (nucleus particles) or coating layer constituting the composite resin particles, which do not contain a lubricant and crystalline polyester.

It is preferred that the particle size of the composite resin particles obtained in this polymerization process (I) are in the range of 10 to 1000 nm as a weight average particle size measured using an electrophoretic light scattering spectrophotometer, "ELS-800" (made by Otsuka Electronics Co., Ltd.).

The glass transition temperature (Tg) of the composite resin particles is preferably in the range of 48 to 74° C., and more preferably from 52 to 64° C. It is preferred that the softening point of the composite resin particles is in the range of 95 to 140° C.

b.3. Salting-Out, Agglomeration and Fusing Process (II)

The salting-out, agglomeration and fusing process (II) is to obtain amorphous (nonspherical) toner particles by salting-out, agglomerating and fusing (salting out and fusion occurs simultaneously) the composite resin particles obtained in the multistage polymerization process (I) with colorant particles.

In the salting-out, agglomeration and fusing process (II), an internal additive particles (fine particles having the number average primary particle size of 10 to 100 nm) such as charge controlling agent can be salted-out, agglomerated and fused together with the composite resin particles and colorant particles.

It is possible that a surface treatment is given to the colorant particles. As for the surface treatment agent, one known in earlier development can be used.

The colorant particles are subject to the salting-out, agglomerating and fusing treatment in a dispersed state in the aqueous medium. The aqueous medium in which the colorant particles are dispersed is possibly an aqueous solution in which a surfactant is dissolved at a concentration not less than the critical micelle concentration (CMC) thereof.

As for the surfactant, the similar surfactant used in the multistage polymerization process (I) can be used.

A dispersing machine used for the dispersing the colorant particles is not especially limited, and preferably includes a mixing apparatus comprising a rotor which rotates at a high speed, "Clearmix" (supplied from M Technique Co., Ltd.), an ultrasonic dispersing machine, a mechanical homogenizer, Manton Gaulin, press dispersing machines such as press type homogenizers, medium type dispersing machines such as Gettman mill and diamond fine mill.

In order to salt-out, agglomerate and fuse the composite resin particles and the coloring agent particles, it is preferable to add a coagulant at not less than a critical agglomeration concentration into dispersions in which the composite resin particles and the colorant particles are dispersed and to heat this dispersion solution at not less than the glass transition temperature (Tg) of the composite resin particles.

More preferably, an agglomeration terminator is used when the particle size of the composite resin particle becomes the desired value by the effect of the coagulant. As for the agglomeration terminator, monovalent metal salt, especially sodium chloride, is preferably used.

A suitable temperature range for the salting-out, agglomerating and fusing is from (Tg+10) to (Tg+50° C.), and especially preferably from (Tg+15) to (Tg+40° C.). In order to effectively perform the fusion, an organic solvent which infinitely dissolves in water may be added.

As for the "coagulant" used in the salting-out, agglomerating and fusing, alkali metal salts as described above and alkali earth metal salts can be given.

b.3.1. Salting-Out and Agglomerating

The salting-out and agglomerating according to the invention will be explained.

"Salting-out, agglomerating and fusing" referred to in the invention represents simultaneous performing of salting-out (agglomeration of particles) and fusion (disappearance of interface between the particles) or an action to simultaneously perform the salting out and the fusion. In order to simultaneously perform the salting out and the fusion, it is preferable to agglomerate the particles (composite resin particles, colorant particles) under a temperature condition not less than the glass transition temperature (Tg) of the resins which compose the composite resin particle.

It is preferable that the toner for electrostatic latent image development in the invention is prepared by a process to form the composite resin particles under non-presence of the colorant particles, adding dispersions of the colorant to the dispersions of the composite resin particles and salting-out, agglomerating and fusing the composite resin particles and colorant.

As described above, since the composite resin particles are prepared under a system including no colorant, it is unlikely that the polymerization reaction for obtaining the composite resin particles is inhibited. Thus, superior resistance to offset property is hardly degraded and contamination of fixing unit and image due to accumulation of the toner is hardly generated.

The manufacturing method of the toner in the invention comprises a process to prepare the dispersions of the resin particles by polymerization reaction of a polymerizable monomer performed in an aqueous medium and a process to add subsequently at least one kind of acid in a process to agglomerate the resin particles or in a process to fuse and associate the resin particles with agglomerating. Therefore, the resin particles having a desired particle size can be obtained in greatly shorter time compared to an agglomeration process or agglomeration, fusion and association process of a manufacturing method in earlier development. As a result, the present invention is successful in dramatically reducing the production cost of the toner of the invention showing high performance compared to a manufacturing method in earlier development.

b.3.2. Variation of Agglomeration Particle Size

Next, the difference between agglomerated particle size variation of resin particles according to a manufacturing method in earlier development and agglomeration particle size variation of resin particles according to the manufacturing method of the toner in the present invention will be explained with reference to FIG. 3.

Figure 3:
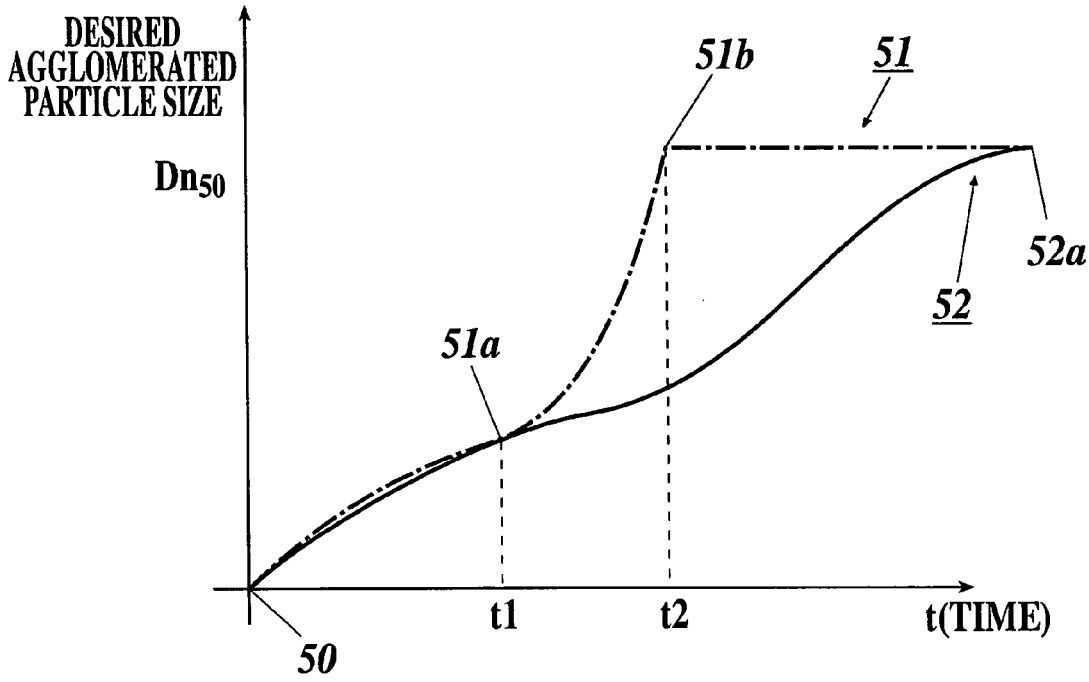
FIG. 3 is a schematic view explaining a manufacturing method of a toner according to the invention, where hydrochloric acid is added in agglomeration or in agglomeration and fusion association of resin particles constituting the toner.

In FIG. 3, reference numeral 52 designates a curve showing a variation with time of particle size of agglomerated resin particles in a manufacturing process of a binder resin of a polymerization toner according to earlier development. Reference numeral 51 designates a curve showing a variation with time of particle size of the agglomerated resin particles in the manufacturing process of the binder resin of the toner according to the present invention.

Both the agglomeration of the resin particles of the binder resin of the polymerization toner according to earlier development and the agglomeration of the binder resin of the toner of the invention start at the point of addition of coagulant to the resin dispersions 50, which is shown in FIG. 3 with labeled 50.

In the curve 52 showing an agglomeration of a polymerization toner according to earlier development, the particle size of the agglomerated particles slowly increases with time from the addition of coagulant 50 to an addition of agglomeration terminator 52*a*.

Compared to the above, in the curve 51 showing an agglomeration of the binder resin of the polymerization toner according to the present invention, the particle size of the agglomerated particles increases similarly with the curve 52 from the addition of coagulant 50 to an addition of acid 51*a* (concretely, hydrochloric acid or sulfuric acid is preferable).

However, it is found that the particle size increases drastically immediately after addition of acid (the variation of the particle size with time is approximately linear) and reaches a desired agglomerated particle size in greatly shorter time compared to the curve 52 according to earlier development.

Presently the reason why the particle size of the agglomerated particles increases drastically by the addition of acid after the start of agglomeration is not certain. Surprisingly, the particle size of the agglomerated particles becomes approximately uniform after an agglomeration terminator is added at the point 51*b*, and the distribution stability of the obtained agglomerated particles is comparatively fine.

As described above, the usage of acid in association of the resin particles has a drastic agglomeration promoting effect as shown in the above curve 51. Thus, it is found that the agglomeration particles having predetermined particle size can be obtained in greatly shorter time compared to earlier development.

Further, since the polymerization reaction for obtaining the composite resin particles is performed precisely, the monomer and oligomer are merely left in the obtained toner particles. It is innovative that off-odor is merely generated in a heat fixing process included in an image forming method using the toner of the invention.

Since the surface property of the obtained toner particles is uniform and the electrostatic charge distribution thereof is sharp, it is possible to form an image having superior sharpness for a long period. The usage of the toner whose composition, molecular weight and surface property are uniform among the toner particles thereof as described above makes it possible to improve the resistance to offset property and resistance to twining property while keeping the fine adhesive property to an image support (high fixing property) in an image forming method including a fixing process by a contact heating method. Thus, an image having proper glossiness can be obtained.

b.4. Chain Transfer Agent

The toner of the invention can be manufactured under a presence of a chain transfer agent such as described below.

For example, ethyl thioglycolate, propyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, compounds of ethylene glycol having mercapto group, compounds of neopentyl glycols having mercapto group, compounds of pentaerythritol having mercapto group and the like can be given.

b.5. Lubricant

The lubricant which is applicable to the toner will be explained.

The content of the lubricant constituting the toner for electrostatic latent image development of the invention is generally 1 to 30 mass %, preferably 2 to 20 mass % and more preferably 3 to 15 mass %.

As for the lubricant, low molecular weight polypropylene (number average molecular weight=1500 to 9000), low molecular weight polyethylene and the like can be added. Ester series compound represented by the following formula is preferable as the lubricant.

$$R_1—(OCO—R_2)_n \qquad \text{General formula}$$

Wherein n represents an integer of 1 to 4, preferably 2 to 4, more preferably 3 or 4, and particularly preferably 4.

R1 and R2 represent hydrocarbon group being capable of having a substituent.

R1: carbon number=1 to 40, preferably 1 to 20 and more preferably 2 to 5

R2: carbon number=1 to 40, preferably 16 to 30 and more preferably 18 to 26

The followings are concrete examples of the ester compound represented by the above general formulas. However, the present invention is not limited thereto.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}-COO—(CH_2)_2-CH(CH_3)—CH_2-O—CO—(CH_2)_{20}—CH_3$

7) $CH_3—(CH_2)_{22}-COO—(CH_2)_2-CH(CH_3)—CH_2-O—CO—(CH_2)_{22}—CH_3$

8) $CH_3—(CH_2)_{22}-COO—CH_2—C(CH_3)_2—CH_2-O—CO—(CH_2)_{22}—CH_3$

9) $CH_3—(CH_2)_{26}-COO—CH_2—C(CH_3)_2—CH_2-O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_2—O—CO—(CH_2)_{26}—CH_3)(CH_2—O—CO—(CH_2)_{26}—CH_3)$

-continued

17)

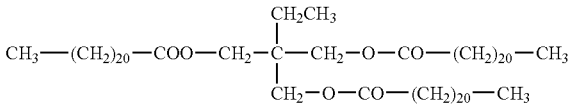

18)

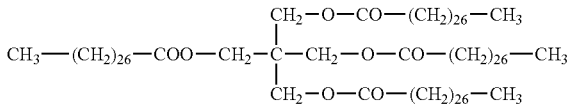

19)

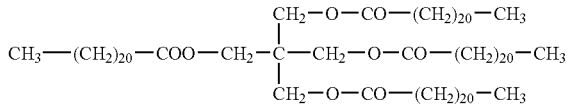

20)

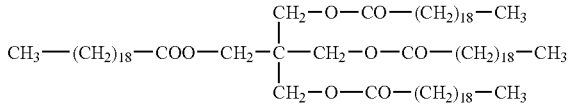

21)

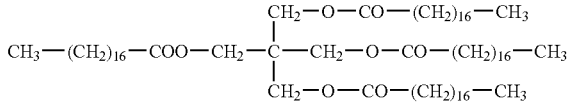

The content of the lubricant described above and a fixing improving agent represented by the general formulas is 1 to 30 mass % with respect to the whole toner for electrostatic latent image development, preferably 2 mass % to 20 mass % and more preferably 3 mass % to 15 mass %.

b.6. Molecular Weight and the Like of the Resin Component Constituting the Toner The preferable molecular weight, molecular weight range, peak molecular weight and the like of the resin component constituting the toner for electrostatic latent image development of the invention will be explained.

In the toner of the invention, peaks or shoulders of the molecular weight distribution thereof exist preferably at 10,000 to 1,000,000 and 1,000 to 50,000, and more preferably the peaks or the shoulders exist at 100,000 to 1,000,000, 25,000 to 150,000 and 1,000 to 50,000.

For the molecular weight of the resin particles, the resin preferably contains at least both components of a high molecular weight component which has a peak or a shoulder in the range of 100,000 to 1,000,000 and a low molecular weight component which has a peak or a shoulder in the range of 1,000 to less than 50,000, and it is more preferable to use the resin with an intermediate molecular weight having a peak or a shoulder in the range of 15,000 to 100,000.

As for the method to measure the above-described molecular weight, it is measured by GPC (gel permeation chromatography) using THF (tetrahydrofuran) as a column solvent.

Concretely, 1 ml of THF is added to 1 mg of a measurement sample, and thoroughly dissolved by stirring at room temperature using a magnetic stirrer and the like. Then, the sample is treated with a membrane filter with a pore size of 0.45 to 0.50 μm, and subsequently injected in GPC. As a measurement condition of GPC, a column is stabilized at 40° C., THF is run at a flow rate of 1 ml/min, and about 100 μl of the sample at concentration of 1 mg/ml is injected to measure. As for the column, it is preferable to use commercially available polystyrene gel columns in combination. For example, the columns can include the combinations of Shodex GPC KF-801, 802, 803, 804, 805, 806 and 807 supplied from Showa Denko K.K. and the combinations of TSK Gel G1000H, G2000H, G3000H, G4000H, G5000H, G6000H, G7000H and TSK guard column supplied from Tosoh Corporation, and the like.

As for the detector, it is preferable to use a refractive index detector (IR detector) or a UV detector. In molecular weight measurement of the sample, the molecular weight distribution of the sample is calculated using a calibration curve measured by using monodisperse polystyrene standard particles. About 10 kinds could be used as polystyrene for making the calibration curve.

b.7. Filtration and Washing Process

The filtration and washing process according to the manufacture of the toner for electrostatic latent image development of the invention will be explained.

The filtration and washing process comprises a filtrating treatment to collect the toner particles from the dispersion system of the toner particles obtained in the above process by filtration, and a washing process to remove an accretion such as a surfactant and coagulant from the filtrate toner particles (cake-like aggregate).

b.7.1. Filtrating Process

The method for filtrating treatment is not especially limited, and centrifuging method, vacuum filtrating method using Nutsche or the like and filtrating method using a filter press or the like can be given.

b.7.2. Drying Process

This process is to dry the toner particles to which the washing treatment has been given.

As for the dryer used in the process, a spray dryer, vacuum freeze dryer, vacuum dryer and the like can be given. It is preferable to use a still rack dryer, moving rack dryer, fluidized bed dryer, rotary dryer, stirring dryer and the like.

The water content of the toner particles after the drying process is preferably 5 mass % or less and more preferably 2 mass % or less.

In the case that the toner particles where the drying process has been given is aggregated one another with weak interparticle force, the aggregate can be subject to a crush treatment. As for the apparatus for the crush treatment, mechanical crushers such as a jet mill, mechanical crushing machine such as Henschel mixer, coffee mill, food processor and the like can be used.

b.8. Polymerizable Monomer

The polymerizable monomer according to the invention will be explained.

b.8.1. Hydrophobic Monomer

Hydrophobic monomers which compose the monomer component are not especially limited, and it is possible to use monomers in earlier development. In order to fulfill the required properties, it is possible to use one or more monomers in combination.

Concretely, monovinyl aromatic series monomers, (meth) acrylate ester series monomers, vinyl ester series monomers, vinyl ether series monomers, monoolefin series monomers, diolefin series monomers, olefin halide series monomers and the like can be used.

As for the vinyl aromatic series monomers, for example, styrene series monomers such as styrene, o-methylstyrene, m-methylstyrene, p-methylstyrene, p-methoxystyrene, p-phenylstyrene, p-chlorostyrene, p-ethylstyrene, p-n-butyl-styrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and the derivatives thereof can be given.

As for the acrylic series monomers, acrylate, methacrylate, methyl acrylate, ethyl acrylate, butyl acrylate, acrylate-2-ethylhexyl, cyclohexyl acrylate, phenyl acrylate, methyl methacrylate, ethyl methacrylate, butyl methacrylate, hexyl methacrylate, methacrylate-2-ethylhexyl, ethyl β-hydroxyacrylate, propyl γ-aminoacrylate, stearyl methacrylate, dimethylaminoethyl methacrylate, diethylaminoethyl methacrylate, and the like can be given.

As for the vinyl ester series monomer, vinyl acetate, vinyl propionate, vinyl benzoate and the like can be given.

As for the vinyl ether series monomer, vinyl methylether, vinyl ethylether, vinyl isobutylether, vinyl phenylether and the like can be given.

As for the monoolefin series monomer, ethylene, propylene, isobutylene, 1-butene, 1-pentene, 4-methyl-1-pentene, and the like can be given.

As for the diolefin series monomer, butadiene, isoprene, chloroprene, and the like can be given.

b.8.2. Cross-Linkable Monomer

In order to improve the property of the resin particles, cross-linkable monomer may be added. As for the cross-linkable monomer, compounds having two or more unsaturated bonds such as divinylbenzene, divinyl naphthalene, divinyl ether, diethyleneglycol methacrylate, ethyleneglycol dimethacrylate, polyethylene glycol dimethacrylate, diallyl phthalate can be given.

b.8.3 Monomer Having Acid Polar Group

As for the monomer having acid polar group, (a) α,β-ethylene series unsaturated compounds having carboxylic group (—COOH) and (b) α,β-ethylene series unsaturated compounds having sulfone group (—$SO_3H$) can be given.

(a) As for the example of α,β-ethylene series unsaturated compounds having —COO group, acrylic acid, methacrylic acid, fumaric acid, maleic acid, itaconic acid, cinnamic acid, monobutyl maleate, monooctyl maleate and the metal salt thereof of Na and Zn and the like can be given.

(b) As for the α,β-ethylene series unsaturated compounds having sulfone group (—$SO_3H$), sulphonated styrene, the Na salt thereof, allyl sulfo succinic acid, allyl sulfo octyl-succinate, the metal salt thereof of Na, and the like can be given.

b.8.4. Initiator

The initiator (also referred to as a polymerization initiator) used for the polymerization of the polymerizable monomer in the invention will be explained.

Any water-soluble polymerization initiator can be properly used in the invention. For example, persulfate (potassium persulfate, ammonium persulfate, etc.), azo series compounds (4,4'-azobis 4-cyano valeric acid and the salt thereof, 2,2'-azobis (2-amidino propane) salt and the like), hydrogen peroxide, and peroxide compounds such as benzoyl peroxide can be given.

Furthermore, the above radical polymerization initiator can be made-into a redox type initiator by combining it with a reducing agent if necessary. By the use of the redox type initiator, polymerization activity is increased, and thus it is possible to lower the polymerization temperature, and further, it is expected to shorten polymerization time.

The polymerization temperature is not especially limited so long as it is not lower than the lowest radical formation temperature of the polymerization initiator, and is in the range of, for example, from 50 to 80° C. It is also possible to perform the polymerization at or close to at room temperature by the use of the polymerization initiator which works at room temperature, such as a combination of hydrogen peroxide and the reducing agent (ascorbic acid, etc).

b.8.5. Chain Transfer Agent

The chain transfer agent used in the invention will be explained.

In the invention, in order to regulate the molecular weight of the resin particle formed by polymerization of the polymerizable monomer, it is possible to use generally-used chain transfer agent in earlier development.

As for the chain transfer agent, it is preferable to use above-described thiol compounds according to the invention.

Other than the thiol compounds, for example, ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, thioglycolate of ethylene glycol, thioglycolate of neopentyl glycol, thioglycolate of pentaerythritol, and the like can be used in combination according to need.

Among them, in a viewpoint of reduce odor in heating and fixing the toner, n-octyl-3-mercaptopropionate is preferably used.

b.8.6. Colorant

The colorant according to the invention will be explained.

The colorant of the toner for electrostatic latent image development according to the invention is preferably salted-out, agglomerated and fused together with the above-described composite resin particles so as to be contained in the toner particles in a viewpoint of improving uniformity of electrostatic charge in the toner.

As for the colorant constituting the toner of the invention (the colorant particles subjected to the salting-out, agglomerating and fusing with the composite resin particles), various inorganic pigments, organic pigments and dyes can be given. As for the inorganic pigment, one known in earlier development can be used. Concrete inorganic pigments will be exemplified below.

As for the black pigment, for example, carbon black such as furnace-black, channel black, acetylene black, thermal black and lamp black, and further magnetic powder such as magnetite and ferrite are used.

It is possible to use these inorganic pigments alone or in combination of multiple types depending on the desire. As the content of the pigments, 2 to 20 mass %, and preferably 3 to 15 mass % based on the polymer is selected.

When used as the magnetic toner, the above-described magnetite can be added. In this case, it is preferable to add the amount of 20 to 120 mass % in the toner from a viewpoint of giving a predetermined magnetic property.

As the organic pigments and the dyes, those conventionally known in earlier development can be used, and concrete organic pigments and dyes are exemplified below.

As for the pigment for magenta and red, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222 and the like can be given.

As for the pigment for orange and yellow, C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156 and the like can be given.

As for the pigment for green and cyan, C.I. pigment blue 15, C.I. pigment blue 15:2, C.I. pigment blue 15:3, C.I. pigment blue 16, C.I. pigment blue 60, C.I. pigment green 7 and the like can be given.

As for the dye, C.I. solvent red 1, 49, 52, 58, 63, 111, 122, C.I. solvent yellow 19, 44, 77, 79, 81, 82, 93, 98, 103, 104, 112, 162, C.I. solvent blue 25, 36, 60, 70, 93, 95 and the like can be given. Furthermore, the mixtures thereof can be also used.

These organic pigment and dye can be used solely and in combination of multiple kinds according to the desire. Here, as for the surface treatment agent, one known in earlier development can be used. The content of the pigment is 2 to 20 mass % based on the polymer, preferably 3 to 15 mass %.

b.8.7. Surface Treatment of the Colorant

Surface treatment may be given to the colorant (colorant particles)constituting the toner for electrostatic latent image development in the invention. As for the surface improving agent, one known in earlier development can be used. Concretely, a silane coupling agent, titanium coupling agent, aluminum coupling agent and the like can be used preferably.

As for the silane coupling agent, alcoxysilanes such as methyl trimethoxysilane, phenyl trimethoxysilane, methyl phenyl dimethoxysilane and biphenyl dimethoxysilane, siloxane such as hexamethyldisiloxane; γ-chloropropyl trimethoxysilane, vinyl trichlorosilane, vinyl trimethoxysilane, vinyl triethoxysilane, γ-meta-chloroxypropyl trimethoxysilane, γ-glycidoxypropyl trimethoxysilane, γ-mercaptopropyl trimethoxysilane, γ-aminopropyl triethoxy silane, γ-ureidopropyl triethoxysilane and the like can be given.

As for the titanium coupling agent, for example, TTS, 9S, 38S, 41B, 46B, 55, 138S, 238S and the like, which are commercially available as the "Plenact" made by Ajinomoto Co., Inc., A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP and the like, which are commercial items made by Nippon Soda Co., Ltd. can be given.

As for the aluminum coupling agent, for example, "Plenact" made by Ajinomoto Co., Inc. and the like can be given.

The content of these surface improving agent is preferably 0.01 to 20 mass % based on the colorant, more preferably 0.1 to 5 mass %.

As for the method to treat the surface of the colorant particles, a method to add the surface treatment agent to the dispersions of the colorant particles and to heat the system so as to carry out a reaction can be given.

The colorant particle to which surface treatment has been given is collected by filtration. After washing process and filtrating process with similar solvent are given repeatedly, the colorant particles are subject to the drying process.

b.9. Internal Additive

The toner particles constituting the toner of the invention may contain an internal additive such as charge controlling agent other than the lubricant.

As for the charge controlling agent contained in the toner particles, nigrosin series dye, metal salt of naphthenic acid or higher fatty acid, alkoxylated amine, quaternary ammonium salt, azo series metal complex, metal salicylate and the metal complex thereof, and the like can be given.

b.10. External Additive

The external additive used in the toner of the invention will be explained.

As for the inorganic fine particles applicable as the external additive, one known in earlier development can be given. Concretely, silica fine particles, titanium fine particles and alumina fine particles and the like can be used preferably. These inorganic fine particles are preferably hydrophobic.

As for the concrete example of the silica fine particles, R-805, R-976, R-974, R-972, R-812 and R-809, which are commercial items made by Nippon Aerosil Co., Ltd., HVK-2150 and H-200, which are commercial items made by Hechest Corp. TS-720, TS-530, TS-610, H-5 and MS-5, which are commercial items made by Cabot Co., Ltd. and the like can be given.

As for the concrete example of the titanium fine particles, for example, T-805 and T-604, which are commercial items made by Nippon Aerosil Co., Ltd., MT-100S, MT-100B, MT-500BS, MT-600, MT-600SS and JA-1, which are commercial items made by Tayca Corp., TA-300SI, TA-500, TAF-130, TAF-510 and TAF-510T, which are commercial items made by Fuji Titanium Industry Co., Ltd., IT-S, IT-OA, IT-OB and IT-OC, which are commercial items made by Idemitsu Kosan Co., Ltd. and the like can be given.

As for the concrete example of the alumina fine particles, for example, RFY-C and C-604 which are commercial items made by Nippon Aerosil Co., Ltd., TTO-55 which is a commercial item made by Ishihara Sangyo Co., Ltd. and the like can be given.

As for the organic fine particles applicable as the external additive, spherical fine particles having number average primary particle size of about 10 to 2000 nm can be given. As for the material of the organic fine particles, polystyrene, polymethylmethacrylate, stylene-methylmethacrylate copolymer and the like can be given.

As for the lubricant which can be used as the external additive, a metal salt of higher fatty acid can be given. As for the concrete examples of the metal salt of higher fatty acid, metal stearate such as zinc stearate, aluminum stearate, copper stearate, magnesium stearate, and calcium stearate; metal oleate such as zinc oleate, manganese oleate, iron oleate, copper oleate, and magnesium oleate; metal palmitate such as zinc palmitate, copper palmitate, magnesium palmitate, and calcium palmitate; metal linoleate such as zinc linoleate and calcium linoleate; metal licinoleate such as zinc ricinoleate and calcium ricinoleate, and the like can be given.

The content of the external additive is preferably about 0.1 mass % to 5 mass % based on the toner.

The adding process of the external additive will be explained.

This process is to add the external additive to the toner particles to which the drying process has been given.

As for the apparatus used to add the external additive, various known mixing machine such as a tabular mixer, Henschel mixer, Nauter mixer and V-mixer and the like can be given.

c. Particle Size of the Toner for Electrostatic Latent Image Development

The particle size of the toner for electrostatic latent image development in the invention will be explained.

The particle size of the toner particles in the invention is 2.5 μm to 7.5 μm in the number average particle size.

The particle size can be controlled by the concentration of the coagulant, loading amount of the organic solvent, fusing time and composition of the polymer in the manufacturing method of the toner which will be described in detail.

When the number average particle size is regulated in the range of 2.5 μm to 7.5 μm, toner fine particles having large adhesivity which flies and adheres to a heating member so as to generate an offset decreases. Further, since transferring efficiency increases, image quality of halftone, micro line, dot and the like are improved.

The number average particle size of the toner can be measured by using Coulter Counter TA-II, Coulter Multisizer, SALD1100 (laser diffraction type particle size analyzer made by Shimadzu Corp.) and the like.

In the invention, a Coulter multisizer is used in which an interface to output particle size distribution (made by Nikkaki-bios Corp.) and a personal computer is connected therewith. An aperture of the Coulter multisizer is selected to 100 μm. The number distribution of the toner with 2 μm or more (for example 2 μm to 40 μm) is measured so that the particle distribution and median particle size are calculated.

c.1. CV Value: Dispersity of the Particle Size Distribution

The dispersity of the particle size distribution is preferably in the range of 10 to 25.

Here, in the particle size distribution, CV value represents dispersity of particle size distribution, and is defined by the following formula. The smaller CV value indicates the sharper particle size distribution.

The particle size distribution mentioned here is measured by laser diffraction type particle size analyzer SALD-1100 (made by Shimadzu Corp.).

$$CV=\sigma 50/d50$$

d50: 50% diameter of particle size distribution (number standard)

σ50: standard deviation where d50 is the standard c.2. Shape Coefficient of the Toner Particle The shape coefficient of the toner particle in the invention will be explained.

The shape coefficient of the toner in the invention is expressed by the following formula and indicates a degree of circularity of the toner particle.

$$\text{Shape coefficient}=((\text{maximum size}/2)^2\times\pi)/\text{projected area}$$

Wherein maximum size represents the width of a particle which is a maximum interval of two parallel lines between which a projected image of the toner particle onto a plane is put, and projected area represents an area of the projected image of the toner particle onto a plane.

In the invention, this shape coefficient is measured by taking the photograph of the toner particle with enlarging it 2000 times by a scanning electron microscope and analyzing the photograph image by "scanning image analyzer" (made by JEOL Ltd.), where 100 pieces of the toner particles are subjected to the measurement of the shape coefficient of the invention according to the above calculation formula.

It is preferable that toner particle having the shape coefficient in the range of 1.0 to 1.6 occupies 65 number % or more in the toner, and 70 number % or more is more preferable. Further, it is more preferable that toner particles having the shape coefficient in the range of 1.2 to 1.6 occupies 65 number % or more in the toner, and 70 number % or more is more preferable.

When the toner particles having the shape coefficient in the range of 1.0 to 1.6 occupies 65 number % or more, the triboelectric property in a developer feeding member or the like become more uniform, over-charged toner is not accumulated and it becomes easier to exchange the toner on the surface of the developer feeding member. Thus, problems such as develop ghost occurs less. Further, contamination of the charge providing member is reduced since the toner particle is hardly crushed. Thus, the electrostatic charge property of the toner becomes stable.

The method to control the shape coefficient is not especially limited. For example, toner having the shape coefficient in the range of 1.0 to 1.6 or 1.2 to 1.6 is obtained by a method of such as spraying the toner particles into heated air flow, giving mechanical energy of impact repeatedly to the toner particle in a gas phase, or adding the toner to solvent which does not dissolve the toner and giving swirl flow, and subsequently the obtained toner is added to an ordinary toner so that the toner is in the scope of the invention. Further, it is also can be given that the toner having the shape coefficient in the range of 1.0 to 1.6 or 1.2 to 1.6 obtained by controlling the whole shape of the toner in the stage of preparing the so-called polymerization toner is added to a ordinary toner similarly to obtain the toner in the invention.

c.3. Particle Size of the Toner

It is preferable in the toner of the invention that the sum (M) of the relative frequency of the toner particles included in the mode class (m1) and the relative frequency of the toner particle included in the second mode class (m2) in a histogram showing particle size distribution in number standard is 70% or more where the horizontal axis is natural logarithm lnD in which D (μm) represents the particle size of the toner particle and the horizontal axis is divided into a plurality of classes in the interval thereof of 0.23.

When the sum of the relative frequency (m1) and (m2) is 70% or more, the dispersion of the particle distribution of the toner particle is narrow. Therefore, occurrence of selected development is absolutely prevented by the use of the toner in an image forming process.

In the invention, the above-described histogram shows the particle size distribution in number standard where the natural logarithm lnD (D: particle size of each toner particle) is divided into a plurality of classes in the interval thereof of 0.23 (0-0.23: 0.23-0.46: 0.46-0.69: 0.69-0.92: 0.92-1.15: 1.15-1.38: 1.38-1.61: 1.61-1.84: 1.84-2.07: 2.07-2.30: 2.30-2.53: 2.53-2.76 . . . ). The data of the particle size distribution related to the sample measured by a Coulter multisizer according to the following condition is transferred to a computer via I/O unit, and the histogram is created on the computer by a particle size analyzing program.

c.3.1. Measurement Condition (1) Aperture: 100 μm (2) Sample preparation: a proper amount of a surfactant (neutral detergent) is added to 50 to 100 ml of electrolyte [ISOTON R-11 (made by Coulter Scientific Japan Corp.)] and stirred. 10 to 20 mg of the measurement sample is added to the solution. The system is subjected to a dispersing treatment for 1 minute with ultrasonic disperser, so that the sample is prepared.

d. Developer

The developer used in the invention will be explained.

The toner of the invention can be used as a single component developer or a double component developer.

When it is used as the single component developer, a non-magnetic single component developer and a magnetic single component developer containing magnetic particles of about 0.1 to 0.5 μm inside the toner can be given, and both of them are available.

The toner also can be used as a double components developer when it is mixed with a carrier. As for the carrier magnetic particles, known materials in earlier development can be used. For example, metals such as iron, ferrite and magnetite, alloys of these metals with such as aluminum and lead, and the like can be given. Especially, ferrite particles are preferable. As for the volume average particle size of the above magnetic particles, 15 to 100 μm is preferable and 25 to 80 μm is more preferable.

The volume average particle size (D4) of the carrier can be measured by laser diffraction type particle size analyzer provided with a wet type dispersing machine "HELOS" (made by Sympatec Corp.).

As for the carrier, a carrier in which magnetic particles are further coated with resin and so-called resin dispersed carrier in which magnetic particles are dispersed in a resin are preferable. The resin composition of the coating is not especially limited, and for example, olefin series resin, styrene series resin, styrene-acryl series resin, silicone series resin, ester series resin, fluorine containing polymer series resin and the like can be given. The resin constituting the resin dispersed carrier is not especially limited and the resin known in earlier development can be used. For example, styrene-acryl series resin, fluorine series resin, polyester resin, phenol resin and the like can be used.

e. Image Forming Method

The image forming method of the invention will be explained.

FIG. 1 is a side section view of main components showing one of embodiments of a laser printer as the image forming apparatus according to the invention. According to FIG. 1, a laser printer 1 is provided with a feeder unit 4 to supply a sheet 3 as a recording material and an image forming unit 5 to form a predetermined image onto the supplied sheet 3 in a main body casing 2.

The feeder unit 4 is provided with a sheet feeding tray 43 removably attached at the bottom part in the main body casing 2, a sheet pressing board 6 provided in the feeding tray 43, a sheet feeding roller 7 and a sheet feeding pat 8 provided above one of the side end part of the sheet feeding tray 43, and a resist roller 9 provided on downstream side of feeding direction of the sheet 3 with respect to the sheet feeding roller 7.

The sheet pressing board 6 is provided in which the sheet 3 can be stacked in pile, one end part thereof which is further from the sheet feeding roller 7 is supported with being capable of oscillating, the other end part thereof is rotatable, and a spring (not shown) biases the backside thereof vertically in upper direction. Therefore, the sheet pressing board 6 rotates downward against the biasing force of the spring with increasing the piled amount of the sheet 3, in which the end part which is further from the sheet feeding roller 7 is a pointing support. The sheet feeding roller 7 and sheet feeding pat 8 are placed with facing each other. A spring 10 is provided on the backside of the sheet feeding pat 8 and presses the sheet feeding pat 8 toward the sheet feeding roller 7. A spring (not shown) presses the uppermost sheet of the sheet 3 located on the sheet pressing board 6 from the backside of the sheet pressing board 6 toward the sheet feeding roller 7. The uppermost sheet 3 is pinched with the sheet feeding roller 7 and sheet feeding pat 8 by the rotation of the sheet feeding roller 7, subsequently the sheet 3 is fed one by one. The resist roller 9 is composed of two rollers of driving side and driven side. The resist roller 9 feeds the sheet 3 fed from the sheet feeding roller 7 to an image forming unit 5 after a predetermined resist.

The image forming unit 5 is provided with a scanner unit 11 as an exposing member constituting an electrostatic latent image developing member, a developing unit 12, a fixing unit 13 and the like.

The scanner unit 11 is provided at the upper part in the main body casing 2 and comprises a laser emitting part (not shown), a polygon mirror 14 driven rotationally, lenses 15 and 16, reflection mirrors 17, 18 and 19, and the like. A laser beam emitted from the laser emitting part based on a predetermined image data passes thorough or is reflected on the polygon mirror 14, lens 15, reflection mirror 17 and 18, lens 16 and reflection plate 19 in this order as shown with the chain line, and irradiates a surface of a photoconductor drum 21 of the developing unit 12 described below with high speed scanning.

Figure 2:
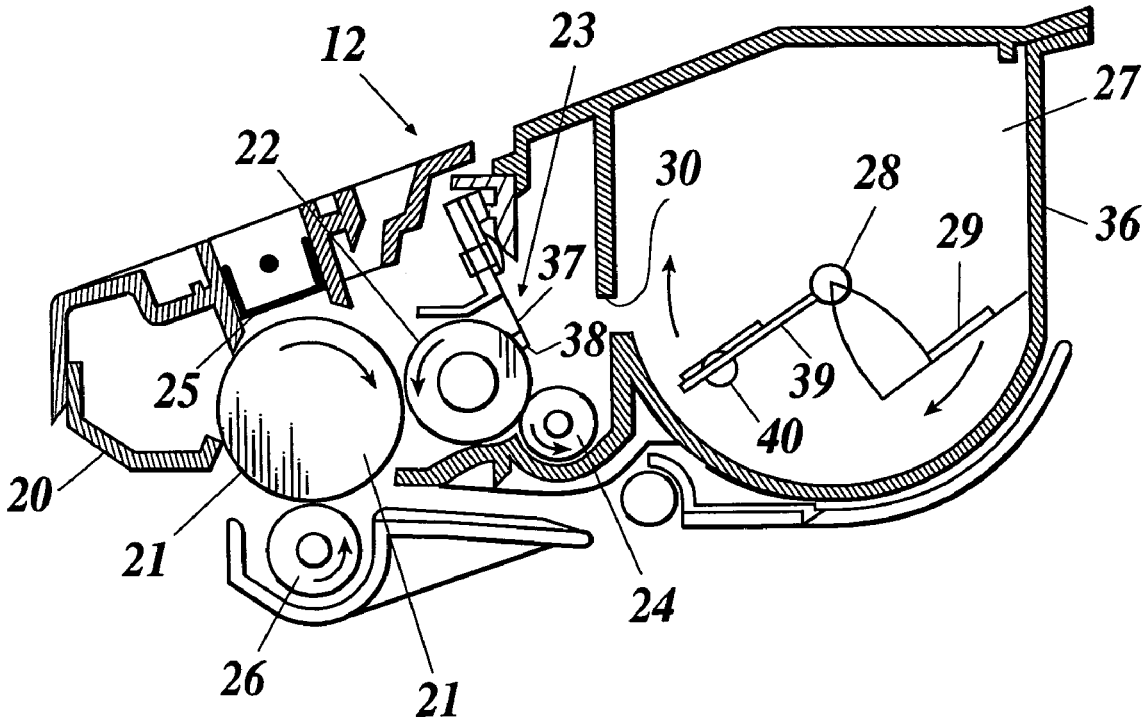
FIG. 2 is an enlarged side section view showing a developing unit.

FIG. 2 is an enlarged side section view showing the enlarged developing unit 12. Next, the developing unit 12 will be explained based on FIG. 2. In FIG. 2, the developing unit 12 is placed below the scanner unit 11 and comprises the photoconductor drum 21 as an image support, a development cartridge 36, a scorotron type electrostatic charger 25 as an electrostatic charging member constituting a electrostatic latent image forming member, a transferring roller 26 as a transferring member, and the like, which are provided in the drum cartridge attached removably on the main body casing 2.

The developing cartridge 36 is attached removably on the drum cartridge 20, and comprises a developing roller 22 as a developer support, a layer thickness controlling blade 23, a supplying roller 24, a toner box 27 and the like.

The toner box 27 is filled with a double components developer consisting of a carrier and toner or a single component developer as a developer.

Further, the image forming apparatus is applicable to image forming apparatuses for both monochrome image and color image. That is, when it is applied to an apparatus for color, a constitution comprising a plurality of photoconductors and a plurality of developing devices, a constitution comprising a plurality of developing machines around one photoconductor, and a constitution of transferring an toner image formed on the photoconductor firstly to an intermediate transfer body and subsequently transferring it to a transfer material can be given.

EMBODIMENTS

Hereinafter, the present invention will be explained with reference to the embodiments. However, the present invention is not limited thereto.

a.1. Preparation of Latex a.1.1. Preparation of Latex 1HML (1) Preparation of Latex (1H) (Formation of Nucleus Particles: The First Stage Polymerization)

Into a 5000 ml separable flask equipped with a stirring unit, a thermal sensor, a cooling tube and a nitrogen introducing unit, a surfactant solution (aqueous medium) where 4 g of an anionic surfactant represented by the following formula (101)

$$C_{10}H_{21}(OCH_2CH_2)_2OSO_3Na \qquad \text{Formula (101)}$$

was dissolved into 3040 g of ion-exchanged water was placed, and the temperature in the flask was raised to 80° C. with stirring at a stirring speed of 230 rpm under a nitrogen gas flow.

An initiator solution where 10 g of a polymerization initiator (potassium persulfate: KPS) was dissolved in 400 g of ion-exchange water was added to this surfactant solution, and the temperature was heated to 75° C., subsequently, a monomer mixture solution made up of 528 g of styrene, 204 g of n-butyl acrylate, 68 g of methacrylic acid and 24.4 g of n-octyl-3-mercaptopropionate was dripped over 1 hour, and the polymerization (first stage polymerization) was performed by heating/stirring this system at 75° C. for 2 hours, so as to prepare latex. This is rendered "latex (1H)".

(2) Preparation of Latex (1HM) (Formation of Intermediate Layer: The Second Stage Polymerization)

In a flask equipped with a stirring unit, 77 g of the compound represented by the above formula (19) (hereinafter referred to as "exemplified compound (19)) is added to a monomer mixture solution made up of 95 g of styrene, 36 g of n-butyl acrylate, 9 g of methacrylic acid and 0.59 g of n-octyl-3-mercaptopropionate ester, and it was heated to 90° C. and dissolved to prepare a monomer solution.

Meanwhile, a surfactant solution where 1 g of the anionic surfactant (the above formula (101)) was dissolved in 1560 ml of ion-exchange water was heated to 98° C., 28 g in terms of solid content of the above latex (1H) which was dispersions of nucleus particles was added to this surfactant solution, and the mixture was mixed and dispersed for 8 hours by a mechanical dispersing machine having a circulation path, "Clearmix" (supplied from M Technique Co., Ltd.), so that dispersions (emulsion) containing emulsified particles (oil droplets) having the dispersion particle size (284 nm) was prepared.

Successively, an initiator solution where 5 g of a polymerization initiator (KPS) was dissolved in 200 ml of ion-exchange water were added to this dispersion solution (emulsion), and the polymerization (second stage polymerization) was performed by heating and stirring this system at 98° C. for 12 hours so as to obtain latex. This is rendered "latex (1HM)".

(3) Preparation of Latex (1HML) (Formation of Outer Layer: The Third Stage Polymerization)

To the latex (1HM) obtained as described above, an initiator solution where 6.8 g of a polymerization initiator (KPS) was dissolved in 265 ml of ion-exchange water was added, and under a temperature condition at 80° C., a monomer mixture solution made up of 249 g of styrene, 88.2 g of n-butyl acrylate, 2 g of methacrylic acid and 7.45 g of n-octyl-3-mercaptopropionate ester was dripped over 1 hour. After the termination of the dripping, the polymerization (third stage polymerization) was performed by heating and stirring the system for 2 hours, and the reaction was cooled to 28° C. to obtain latex. This latex is rendered "latex (1HML)". A weight average particle size of the composite resin particles constituting this latex (1HML) was 122 nm.

a.1.2. Preparation of Latex 2L (Shell Agent)

Into a flask equipped with a stirrer, initiator solution where 14.8 g of a polymerization initiator (KPS) was dissolved into 400 ml of ion-exchanged water is placed, and monomer mixture made up of 600 g of styrene, 190 g of n-butylacrylate, 10.0 g of metacrylic acid, 20.8 g of n-octyl-3-mercaptopropyonate was dripped therein over 1 hour. After the completion of the dripping, the system was heated and stirred for 2 hours so as to perform polymerization, and subsequently was cooled to 27° C., so that latex (dispersions of resin particles made up of low molecular weight resin) is obtained. This latex is rendered "latex (2L)".

The resin particles constituting the latex (2L) has the peak molecular weight of 11,000 and weight average particle size of 128 nm.

a.2. Example of the Resin Particles

The colored particles Bk1 (black) was prepared as described below.

a.2.1. Preparation of Colored Particle Bk1: Black (1) Preparation of Colorant Dispersions 1

The anionic surfactant represented by the above formula (101) (90 g) was dissolved in 1600 ml of ion-exchange water with stirring. As this solution was stirred, 400.0 g of carbon black, (Regal 330R, made by Cabot Corporation) was gradually added, and then dispersion treatment was given to the solution using a stirring machine "Clearmix" (made by M Technique Co., Ltd.) so as to prepare a dispersion solution of colorant particles (hereinafter, referred to as "colorant dispersions 1").

When particle diameters of the colorant particles in this colorant dispersions 1 were measured using an electrophoretic light scattering spectrophotometer, "ELS-800" (supplied from Otsuka Electronics Co., Ltd.), it was 110 nm.

(2) Preparation of (Agglomerated·Fused) Associated Particles

The latex (1HML) (420.7 g in terms of solid content), 900 g of ion-exchange water and 200 g of the "colorant dispersions 1" were placed and stirred in a reaction container (four-necked flask) equipped with a temperature sensor, a cooling tube, a nitrogen introducing unit and a stirring unit. After adjusting the internal temperature of the container to 30° C., an aqueous solution of sodium hydroxide at 5 mol/L was added to this solution to adjust the pH to 10.0.

Then, aqueous solution where 2 g of magnesium chloride 6-hydrate was dissolved in 1000 ml of ion-exchange water was added over 10 mm at 30° C. under stirring. After leaving it for 3 min, temperature rising was started, and this system was heated to 90° C. over 30 mm. In that state, particle sizes of associated particles were measured by "Coulter Counter TA-II". At the time point when the number average particle size becomes 2.5 μm, 825.3 g of 2 mol/l hydrochloric acid was added. It was observed that the enlarging rate (agglomerating rate) of the particle size increased at that point.

At the point when the number average particle size became 4.4 μm, aqueous solution where 40.2 g of sodium chloride was dissolved to 1000 ml of ion-exchanged water was added so that the particle growth was terminated. As an aging process, solution temperature was further heated at 98° C. for 2 hours with stirring, so that the fusion is continued.

(3) Shelling Treatment

Latex 2L (dispersions of the resin particles, 96 g) was added, and was heated and stirred for 3 hour, so that latex 2L is fused with the surface of the agglomerated particles of latex (1HML). Sodium chloride (40.2 g) was added and the system was cooled to 30° C. at the rate of 8° C./min. Hydrochloric acid was added to regulate pH of the system to 2.0, and the stirring was stopped. Formed salted-out, agglomerated and fused particles were collected by filtration, washed with ion-exchanged water at 45° C. repeatedly and subsequently dried with warm air-blow at 40° C., so that colored particles Bk1 was obtained.

a.2.2. Preparation of Colored Particles Bk2 to Bk8

In a similar process to the preparation of Bk1, except type, concentration and amount of the acid used in a preparation of (agglomerated-fused) associated particles are changed as shown in Table 1, colored particles Bk2 to Bk8 are prepared respectively.

TABLE 1

| COLORED PARTICLE NO. | CONCENTRATION, TYPE AND AMOUNT OF ACID USED IN PREPARATION OF ASSOCIATED PARTICLES | | |
|---|---|---|---|
| | ACID CONCENTRATION | AMOUNT (g) | REMARKS |
| Bk1 | 2 mol/l | 825.3 | HYDROCHLORIC ACID |
| Bk2 | 1 mol/l | 412.8 | HYDROCHLORIC ACID |
| Bk3 | 3 mol/l | 1650.6 | HYDROCHLORIC ACID |
| Bk4 | 2 mol/l | 412.8 | SULFUR ACID |
| Bk5 | 1 mol/l | 206.4 | SULFUR ACID |
| Bk6 | 3 mol/l | 825.3 | SULFUR ACID |
| Bk7 | None | 0 | NONE |
| Bk8 | 4 mol/l | 3301.2 | HYDROCHLORIC ACID |

a.3. Preparation of Black Toner Particles Bk1 to Bk8

Each of The above described colored particles Bk1 to Bk8 (100 parts by mass), 0.4 parts by mass of hydrophobic silica (average primary particle size 12 nm, treated with cyclosilazane to be hydrophobic, degree of hydrophibicity 80%) and 1.0 parts by mass of hydrophobic titanium (average primary particle size of 110 nm, treated with N-butyltrimetoxysilane to be hydrophobic, degree of hydrophobicity 40%) were mixed with Henschel mixer, so that black toner particles Bk1 to Bk8 were prepared respectively.

a.3.1. Measurement of Contents of Acrylate and Aliphatic Alcohol

For each of the obtained black toner particles Bk1 to Bk8, content of acrylate monomer and aliphatic alcohol of 4 to 12 carbons in the toner ware measured respectively by the above described head space method. The obtained results are shown in Table 2.

a.3.2. Content Ratio of Metal Elements to Chlorine or Sulfur Contained in the Toner (Molar Ratio)

For each of the obtained black toner particles Bk1 to Bk8, the elements group consisting of sodium, potassium, magnesium, zinc and aluminum in the toner was quantitatively analyzed by WDX (wavelength dispersive X-ray diffractometory). The ratio of total amount of the elements (mol) to chlorine or sulfur (molar ratio) was obtained according to the above general formula (1) or (2). The obtained results are shown in Table 2.

TABLE 2

| TONER PARTICLE NO. | ACRYLATE MONOMER (ppm) | ALIPHATIC ALCOHOL (ppm) | B/A | C/A |
|---|---|---|---|---|
| Bk1 | 0.56 | 86.67 | 2.9 | 10.2 |
| Bk2 | 1.82 | 60.46 | 3.7 | 7.2 |
| Bk3 | 0.01 | 267.93 | 4.8 | 5.1 |
| Bk4 | 5.52 | 129.67 | 0.8 | 15.8 |
| Bk5 | 11.82 | 41.79 | 1.2 | 17.6 |
| Bk6 | 3.46 | 292.33 | 0.7 | 19.7 |
| Bk7 | 13.2 | 38 | 0.5 | 5 |
| Bk8 | 0 | 321 | 5.6 | 4.8 |

a.4. Preparation of the Developer

Subsequently, Ferrite carrier covered with silicone resin having volume average particle size of 60 μm was mixed with each of the toner particles shown in table 2, so that developer for black color Bk1 to Bk8 having the toner concentration of 6% were prepared respectively.

a.5. Print Evaluation

Each of the obtained developer for black color Bk1 to Bk8 was set on the image forming apparatus shown in FIG. 1. Stability of the developer, resolution, and lifetime of the charge providing member were evaluated respectively.

a.5.1. Stability of the Developer

A patch image aiming 0.6 mg/cm$^2$ and a patch image aiming 0.3 mg/cm$^2$ were developed for 20 times respectively. Adhered developer on the photoconductor was peeled with an adhesive tape. The adhered amounts were measured and classified according to the following criteria.

A: An actual adhered amount shows dispersion of ±2.5% or less in an adhered amount setting.

B: An actual adhered amount shows dispersion of ±3.0% or less in an adhered amount setting.

C: An actual adhered amount shows dispersion more than 3.0% in adhered amount setting.

a.5.2. Resolution

A test chart for judging resolution was printed. The test chart was observed under a 20× magnifier, and the resolution thereof was evaluated and classified according to the following criteria.

A: Lines up to 14 lines/mm can be identified in both main and sub scanning direction.

B: Lines up to 10 lines/mm can be identified in both main and sub scanning direction.

C: Lines of 10 lines/mm can not be identified in both main and sub scanning direction.

a.5.3. Lifetime of the Charge Providing Member

The developing roller and a layer thickness controlling member constituting the charge providing member were subject to the following evaluation.

A: Both the developing roller and layer thickness controlling member have lifetime of 5,000,000 prints or more.

B: Both the developing roller and layer thickness controlling member have lifetime of 3,000,000 prints or more to less than 5,000,000 prints.

C: Both the developing roller and layer thickness controlling member have lifetime of less than 3,000,000, and necessary to be exchanged.

The obtained results are shown in Table 3.

TABLE 3

| DEVELOPER NO. | TONER PARTICLE NO. | STABILITY OF DEVELOPER | RESOLUTION | LIFETIME OF CHARGE PROVIDNG MEMBER |
|---|---|---|---|---|
| BK1 | Bk1 | A | A | A |
| BK2 | Bk2 | A | A | A |
| BK3 | Bk3 | A | B | A |
| BK4 | Bk4 | A | A | A |
| BK5 | Bk5 | B | B | B |
| BK6 | Bk6 | A | B | B |
| BK7 | Bk7 | C | C | C |
| BK8 | Bk8 | B | C | C |

As shown in FIG. 3, it is found that stability of the developer is high, the obtained image shows high resolution and the charge providing member of the image forming apparatus has long lifetime in Bk1 to Bk6, compared to Bk7 and Bk8.

As shown in the above examples, the present embodiment is successful in providing the toner where develop amount is stable, high resolution image can be obtained, lifetime of a charge providing member is long, a downtime for an exchange can be greatly reduced. Furthermore, the present invention is successful in providing the manufacturing method of a toner having high productivity. That is, the present invention is successful in preventing a small size toner from being over-charged by the toner containing aliphatic alcohol of particular number of carbons and residual acrylate left in the toner within a particular range.

The entire disclosure of Japanese Patent Applications No.2003-339535 filed on Sep. 30, 2003, including specification, claims, drawings and summary are incorporated herein by reference in its entirety.

What is claimed is:

1. A toner for electrostatic latent image development containing a toner particle comprising a binder and a colorant, the toner particle having a number average particle size of 2.5 μm to 7.5 μm, acrylace of less than 12 ppm, aliphatic alcohol of 4 to 12 carbons of 40 ppm to 300 ppm.

2. The toner for electrostatic latent image development of claim 1, further containing at least one element selected from the group consisting of sodium, potassium, magnesium, zinc and aluminum, wherein a ratio (B/A) of a content A of the element in the toner to a content B of chlorine element in the toner fulfills the following formula $$0.7<B/A<5.$$

3. The toner for electrostatic latent image development of claim 2, wherein the ratio (B/A) fulfills the following formula $$0.97<B/A<3.$$

4. The toner for electrostatic latent image development of claim 2, wherein the ratio (B/A) fulfills the following formula $$1.1<B/A<2.5.$$

5. The toner for electrostatic latent image development of claim 2, wherein the acrylate is at least one selected from the group consisting of methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

6. The toner for electrostatic latent image development of claim 5, wherein a content of the acrylate in the toner is 6 ppm or less and a content of the aliphatic alcohol in the toner is 100 ppm to 200 ppm.

7. The toner for electrostatic latent image development of claim 1, further containing at least one element selected from the group consisting of sodium, potassium, magnesium, zinc and aluminum, wherein a ratio (C/A) of a content A of the element in the toner to a content C of sulfur element in the toner fulfills the following formula $$5<C/A<20.$$

8. The toner for electrostatic latent image development of claim 7, wherein the ratio (C/A) fulfills the following formula $$6<C/A<15.$$

9. The toner for electrostatic latent image development of claim 7, wherein the ratio (C/A) fulfills the following formula $$8<C/A<12.$$

10. The toner for electrostatic latent image development of claim 7, wherein the acrylate is at least one selected from the group consisting of methyl acrylate, ethyl acrylate, isopropyl acrylate, nbutyl acrylate, tbutyl acrylate, isobutyl acrylate, n-octyl acrylate, 2-ethylhexyl acrylate, stearyl acrylate, lauryl acrylate and phenyl acrylate.

11. The toner for electrostatic latent image development of claim 10, wherein a content of the acrylate in the toner is 6 ppm or less and a content of the aliphatic alcohol in the toner is 100 ppm to 200 ppm.

12. The toner for electrostatic latent image development of claim 1, wherein the acrylate is at least one selected from the group consisting of methyl acrylate, ethyl acrylate, isopropyl acrylate, n-butyl acrylate, t-butyl acrylate, isobutyl acrylate, n-octyl acrylate, 2-ethylbexyl acrylate, stearyl acrylate, lauryl acrylate and phenyl acrylate,.

13. The toner for electrostatic latent image development of claim 1, wherein a content of the acrylate in the toner is 6 ppm or less.

14. The toner for electrostatic latent image development of claim 1, wherein a content of the acrylate in the toner is 0 to 3 ppm.

15. The toner for electrostatic latent image development of claim 1, wherein a content of the aliphatic alcohol is 70 ppm to 250 ppm.

16. The toner for electrostatic latent image development of claim 1, wherein the number of carbon in the aliphatic alcohol is 4 to 9.

17. The toner for electrostatic latent image development of claim 1, wherein a polymerizable monomer used in manufacturing the binder resin which is a component of the toner is at least one selected from the group consisting of styrene, o-methyl styrene, in-methyl styrene, p-methyl styrene, α-methyl styrene, p-chlorostyrene, 3,4-dichlorostyrene, p-phenyl styrene, p-ethyl styrene, 2,4-dimethyl styrene, p-tert-butyl styrene, p-n-hexyl styrene, p-n-octyl styrene, p-n-nonyl styrene, p-n-decyl styrene, p-n-dodecyl styrene, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, ethylene, propylene, isobutylene, vinyl chloride, vinylidene chloride, vinyl bromide, vinyl fluoride, vinylidene fluoride, vinyl propionate, vinyl acetate, and vinyl benzoate, vinylmethyl ether, vinylethyl ether, vinylmethyl ketone, vinylethyl ketone, vinylhexyl ketone, N-vinylcarbazoie, N-vinyl indole, N-vinyl pyrrolidone, vinyl naphthalene, vinylpyridine, acrylonitrile, methacrylonitrile, and acrylamide.

* * * * *